US005118985A

United States Patent [19]

Patton et al.

[11] Patent Number: 5,118,985

[45] Date of Patent: Jun. 2, 1992

[54] FLUORESCENT INCANDESCENT LAMP

[75] Inventors: Robert J. Patton, Acton; Kailash C. Mishra, Chelmsford; Ernest A. Dale, Hamilton; Costas Lagos, Danvers, all of Mass.

[73] Assignee: GTE Products Corporation, Danvers, Mass.

[21] Appl. No.: 727,299

[22] Filed: Jul. 9, 1991

Related U.S. Application Data

[63] Continuation of Ser. No. 458,923, Dec. 29, 1989, abandoned.

[51] Int. Cl.[5] ..... H01K 1/32

[52] U.S. Cl. ..... 313/485; 313/487; 313/578; 313/315

[58] Field of Search ..... 313/25, 112, 113, 465, 313/483, 485, 502, 487, 161, 578, 491; 315/248, 109.3; 372/80; 346/110 R

[56] References Cited

U.S. PATENT DOCUMENTS

| | | | |
|---|---|---|---|
| 2,405,261 | 8/1946 | Levi et al. | 313/112 |
| 2,759,119 | 8/1956 | Thorington | 313/578 X |
| 3,947,719 | 3/1976 | Ott | 313/112 X |
| 4,097,776 | 6/1978 | Allinikov | 313/502 |
| 4,645,290 | 2/1987 | Walsh | 313/112 X |
| 4,727,283 | 2/1988 | Van Kemenade et al. | 313/487 |

FOREIGN PATENT DOCUMENTS

| | | | |
|---|---|---|---|
| 0027334 | 4/1981 | European Pat. Off. | 313/112 |
| 0147677 | 11/1979 | Japan | 313/112 |

*Primary Examiner*—Donald J. Yusko
*Assistant Examiner*—Ashok Patel
*Attorney, Agent, or Firm*—Martha Ann Finnegan; Robert E. Walter

[57] ABSTRACT

An incandescent lamp is provided with a phosphor coating on its lamp envelope. The phosphor coating alters the spectral distribution of radiation emitted by the lamp and acts as a diffuser. In one embodiment, the phosphor coating absorbs radiation at wavelengths below 500 nanometers and emits radiation at wavelengths above 500 nanometers to provide an improved bugfoiler lamp. In another embodiment, the phosphor coating absorbs radiation in the ultraviolet, violet and blue wavelength range and emits radiation at longer wavelengths that more effectively stimulate the human eye.

1 Claim, 4 Drawing Sheets

FLUORESCENT INCANDESCENT LAMP

This is a continuation of copending application Ser. No. 07/458,923, filed on Dec. 29, 1989, now abandoned.

FIELD OF THE INVENTION

This invention relates to incandescent electric lamps and, more particularly, to incandescent lamps which have a luminescent phosphor coating on the lamp envelope to alter the spectral distribution of the radiation emitted by the lamp.

BACKGROUND OF THE INVENTION

Soft white incandescent lamps utilize a clear glass lamp envelope which has been coated with a fine transparent powder, usually silica, on its inside wall. The powder diffuses the light from the filament so that the eye cannot form a focused image of the filament. The silica powder does not alter the spectrum of the light emitted from the filament. Some light is lost due to reverse scattering by the silica powder.

Lamps known as "bugfoiler" lamps emit radiation in a range of wavelengths which is poorly seen by many insects. Prior art bugfoiler lamps have utilized a cadmium sulfide coating on the lamp envelope. The cadmium sulfide acts as a filter and attenuates wavelengths less than 500 nanometers more than wavelengths above 500 nanometers. Consequently, the radiation emitted by the lamp is primarily in a wavelength range above 500 nanometers. Such bugfoiler lamps are relatively inefficient, since the shorter wavelengths are unused. In addition, the cadmium sulfide coating is toxic.

The human eye is much more sensitive to wavelengths in the yellow portion of the spectrum than to wavelengths in the violet and blue portions of the spectrum. Thus, radiation emitted by an incandescent lamp in ultraviolet, violet and blue portions of the spectrum produces very little stimulation of the human eye.

Luminescent phosphors are widely used in fluorescent lamps to convert ultraviolet radiation to visible radiation. The phosphor is a coating on the lamp envelope. The phosphor absorbs radiation in one wavelength range and emits radiation in another wavelength range. To our knowledge, luminescent phosphors have not been used on incandescent lamps.

It is a general object of the present invention to provide improved incandescent lamps.

It is another object of the present invention to provide an incandescent lamp having a luminescent phosphor coating to alter the spectral distribution of radiation emitted by the lamp.

It is a further object of the present invention to provide incandescent lamps having high luminous efficacy.

It is yet another object of the present invention to provide improved lamps that are poorly seen by insects.

SUMMARY OF THE INVENTION

According to the present invention, these and other objects and advantages are achieved in an incandescent lamp comprising a light transmissive envelope, a filament mounted within the envelope, means for coupling electrical energy to the filament, and a luminescent phosphor coating on a surface of the envelope, the phosphor coating being selected to absorb radiation from the filament in a first wavelength range and to emit radiation in a second wavelength range so that the phosphor coating alters the spectral distribution of radiation emitted by the lamp.

In one embodiment of the invention, the phosphor coating absorbs radiation in a wavelength range including ultraviolet, violet and blue radiation and emits visible radiation in a longer wavelength range that more effectively stimulates the human eye.

According to another embodiment of the invention, the phosphor coating is selected to absorb visible radiation in a wavelength range below 500 nanometers and to emit radiation in a wavelength range above 500 nanometers so that the lamp is poorly seen by insects during operation. The lamp having a phosphor coating can provide a nontoxic bugfoiler lamp depending on the phosphor used.

The phosphor coating is disposed on an inside surface of the lamp envelope and preferably has sufficient thickness to diffuse radiation emitted by the filament. Preferred phosphor coatings include yttrium aluminum garnet doped with cerium (YAG:Ce), lithium titanate doped with manganese ($Li_2TiO_3$:Mn) and combinations thereof.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
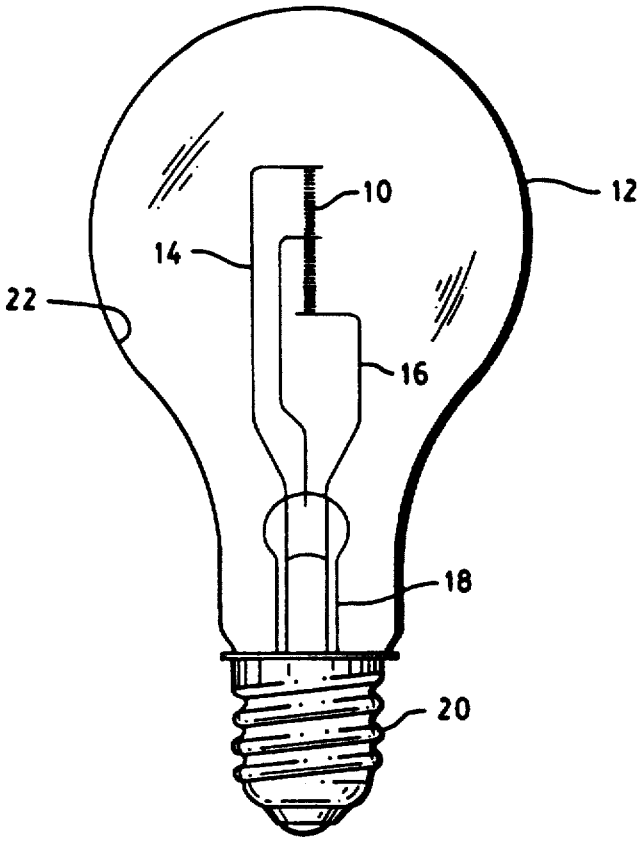
FIG. 1 is a cross sectional elevational view of an incandescent lamp in accordance with the invention.

A cross-sectional view of an incandescent lamp incorporating the present invention is shown in FIG. 1. A tungsten filament 10 is mounted within a glass envelope 12. The filament 10 is mechanically supported within the envelope by electrical leads 14 and 16. The electrical leads 14 and 16 extend through a lamp stem 18 to a lamp base 20. A luminescent phosphor coating 22 is disposed on the inside surface of lamp envelope 12.

The function of the luminescent phosphor coating is to absorb radiation from filament 10 in a first wavelength range and to emit radiation in a second wavelength range. Thus, the phosphor coating alters the spectral distribution of the radiation emitted by the lamp. The phosphor coating 22 preferably diffuses light passing through envelope 12 so that the filament 10 is not visible through envelope 12 during operation.

In one preferred embodiment of the invention, the phosphor coating 22 increases the efficacy of the lamp relative to incandescent lamps not having a phosphor coating. It is known that the human eye is much less sensitive to radiation in the blue and violet portions of the visible spectrum than to radiation in the yellow and green portions of the visible spectrum. In order to improve the luminous efficacy of the lamp, a phosphor coating 22 which absorbs radiation in a portion of the spectrum including ultraviolet, violet and blue wavelengths is utilized. The phosphor coating 22 is selected to emit radiation in a portion of the visible spectrum where the human eye is highly sensitive. The phosphor coating converts ultraviolet radiation and radiation at the low end of the visible spectrum to longer wavelength radiation that is more useful for illumination.

According to another aspect of the invention, the phosphor coating 22 is used to provide an improved bugfoiler lamp which is poorly seen by many insects. It is known that radiation at wavelengths above about 500 nanometers is poorly seen by many insects and that lamps having radiation limited to wavelengths above 500 nanometers do not attract insects. The phosphor coating 22 is selected such that wavelengths in a range below 500 nanometers are absorbed by phosphor coating 22, and radiation in a wavelength range above 500 nanometers is emitted by the phosphor coating. The phosphor coating 22 improves the operating efficiency of a bugfoiler lamp since radiation at wavelengths less than 500 nanometers is converted to useful radiation above 500 nanometers rather than being attenuated by a filter. In addition, the bugfoiler lamp with phosphor coating 22 can provide a nontoxic lamp, depending the the phosphor used.

The phosphor coating 22 can be applied to the inside surface of lamp envelope 12 using conventional electrostatic coating techniques. Alternatively, the phosphor material can be dispersed in an organic lacquer and applied as a coating on the inside surface of envelope 12. Then the envelope 12 is placed in an oven, and the lacquer is baked off, leaving a phosphor coating on the glass surface.

Figure 2:
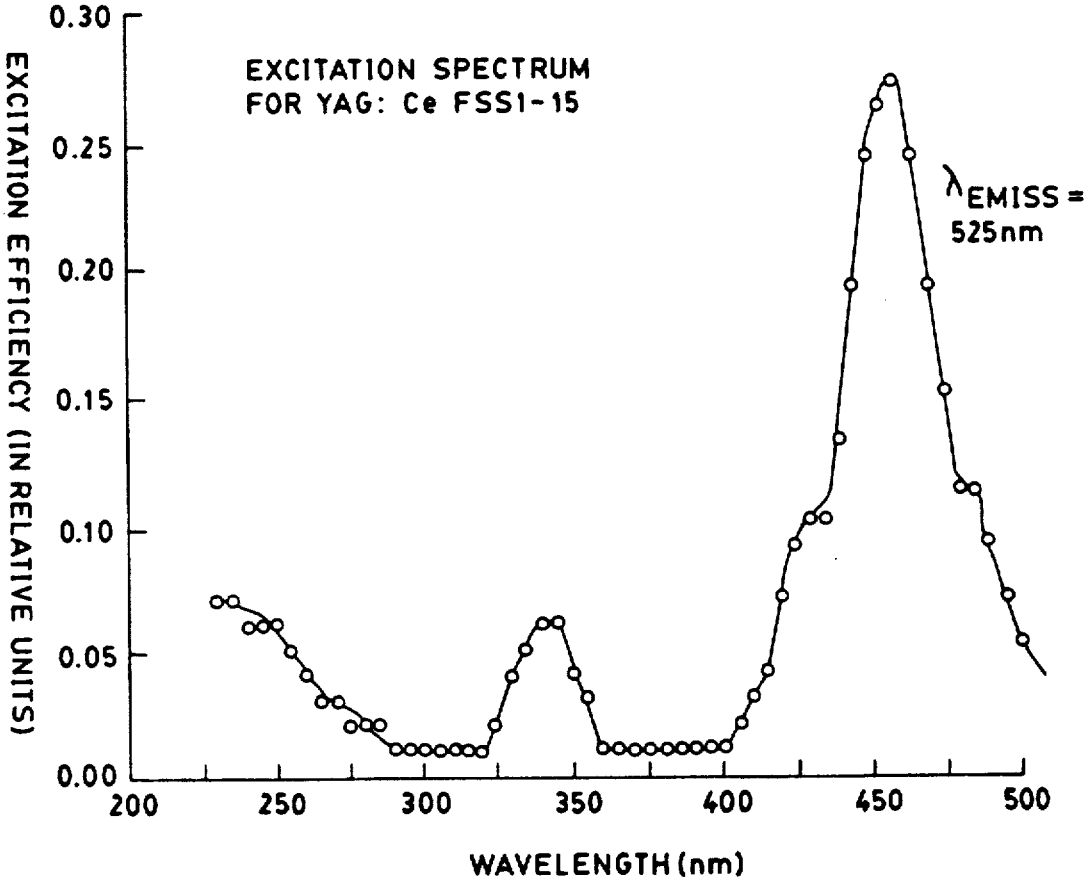
FIG. 2 is a graph which illustrates the excitation spectrum of a preferred phosphor coating.
Figure 3:
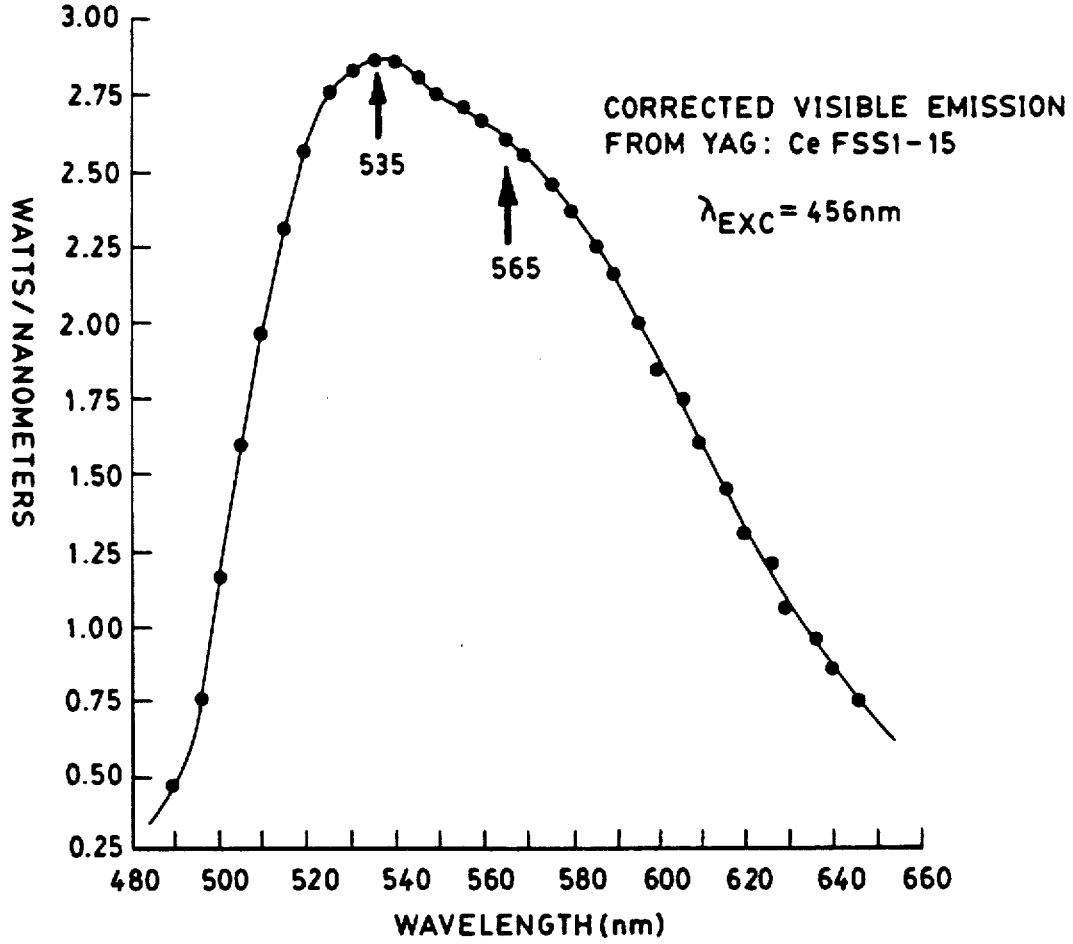
FIG. 3 is a graph which illustrates the emission spectrum of the phosphor coating of FIG. 2.

One preferred phosphor coating is yttrium aluminum garnet doped with cerium (YAG:Ce). The excitation spectrum of YAG:Ce is shown in FIG. 2 where the relative excitation efficiency is plotted as a function of wavelength for a wavelength range of 225 nanometers to 500 nanometers. It is seen from FIG. 2 that the maximum absorption of YAG:Ce occurs at 456 nanometers. The emission spectrum of YAG:Ce when stimulated with radiation at 456 nanometers is shown in FIG. 3 in which output power is plotted as a function of wavelength. A major portion of the emitted radiation is in a wavelength range above 500 nanometers.

Another suitable phosphor coating is lithium titanate doped with manganese ($Li_2TiO_3$:Mn). Lithium titanate doped with manganese can be used alone or in a mixture with YAG:Ce to produce a desired output spectrum. Lithium titanate doped with manganese has a broad excitation spectrum in a range of about 300–500 nanometers and a maximum in its emission spectrum at about 640 nanometers. Other suitable phosphors include most luminescent phosphors which are activated by a manganese in the +4 valence state, and zinc sulfide doped with copper and manganese.

Figure 4:
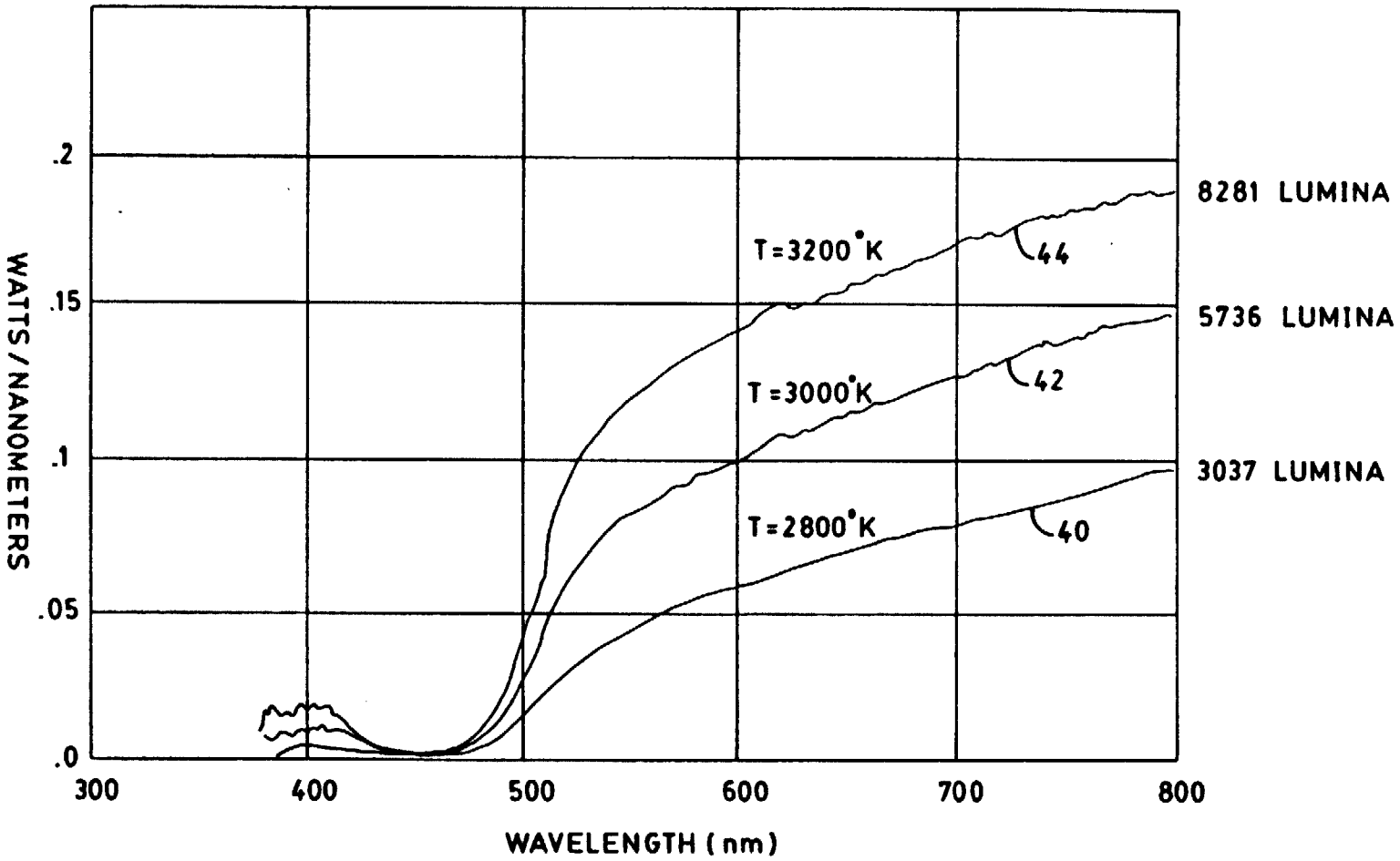
FIG. 4 is a graph which illustrates the spectral power distribution of an incandescent lamp having a phosphor coating of the type shown in FIGS. 2 and 3, for various filament temperatures.

Spectral power distribution curves for a 200 watt incandescent lamp having a YAG:Ce phosphor coating are shown in FIG. 4 wherein watts per nanometer emitted are plotted as a function of wavelength. Curves 40, 42 and 44 demonstrate the spectral performance for filament temperatures of 2800° K., 3000° K. and 3200° K., respectively. The corresponding lumen outputs are 3037, 5736 and 8281 lumens, respectively. The lamp represented by FIG. 4 provides about 70% more light output than prior art bugfoiler lamps. It is seen from FIG. 4 that very little radiation is emitted by the lamp at wavelengths less than 500 nanometers.

With reference to FIG. 4, it is noted that a lamp having a YAG:Ce phosphor coating has some output in a wavelength range of about 400 nanometers. In addition, the lamp output reaches a minimum at a wavelength somewhat below 500 nanometers. Thus, the lamp may be somewhat visible to insects. By using a phosphor coating comprising a mixture of YAG:Ce and $Li_2TiO_3$:Mn, the lamp output at about 400 nanometers is eliminated and the entire spectral curve is shifted to the right (longer wavelengths), thus providing a lamp that is less visible to insects. However, the addition of $Li_2TiO_3$:Mn reduces the lumen output of the lamp. A desired spectrum and lumen output can be obtained by a selected ratio of YAG:Ce and $Li_2TiO_3$:Mn.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An incandescent lamp comprising:

a light-transmissive envelope;

a filament mounted within said envelope;

means for coupling electrical energy to said filament; and a luminescent phosphor coating on a surface of said envelope, said phosphor coating being selected to absorb radiation from said filament in a first wavelength range including ultraviolet, violet and blur radiation and to emit visible radiation in a second wavelength range having wavelengths longer than wavelengths in said first wavelength range, said phosphor coating consisting of a mixture of YAG:Ce phosphor and $Li_2TiO_3$:Mn phosphor, said $Li_2TiO_3$:Mn phosphor having manganese in the +4 valence state and a maximum in emission spectrum at about 640 nonometers, said mixture comprising a sufficient amount of $Li_2TiO_3$:Mn phosphor for shifting the spectral output wherein substantially no spectral output is present at about 400 nanometers and below about 500 nanometers so that the lamp output is poorly seen by insects during operation.

* * * * *